US010550513B2

(12) United States Patent
Zimmerman et al.

(10) Patent No.: US 10,550,513 B2
(45) Date of Patent: Feb. 4, 2020

(54) FABRIC TREATMENT COMPOSITIONS AND METHODS

(71) Applicants: HBI Branded Apparel Enterprises, LLC, Winston Salem, NC (US); Cotton Incorporated, Cary, NC (US)

(72) Inventors: Keith Zimmerman, Winston-Salem, NC (US); Sha Fu, Cary, NC (US); Matthew J. Farrell, Cary, NC (US)

(73) Assignees: HBI Branded Apparel Enterprises, LLC, Winston Salem, NC (US); Cotton Incorporated, Cary, NC (US)

( * ) Notice: Subject to any disclaimer, the term of this patent is extended or adjusted under 35 U.S.C. 154(b) by 0 days.

(21) Appl. No.: 16/013,583

(22) Filed: Jun. 20, 2018

(65) Prior Publication Data

US 2018/0371689 A1 Dec. 27, 2018

Related U.S. Application Data

(60) Provisional application No. 62/523,619, filed on Jun. 22, 2017.

(51) Int. Cl.
*D06P 5/00* (2006.01)
*D06P 3/60* (2006.01)
(Continued)

(52) U.S. Cl.
CPC ..... *D06P 5/002* (2013.01); *D06M 13/395* (2013.01); *D06M 15/227* (2013.01); *D06M 15/507* (2013.01); *D06P 3/6033* (2013.01)

(58) Field of Classification Search
CPC ..... D06P 5/002; D06P 1/5271; D06P 3/6033; D06P 3/54; D06P 3/52; D06M 3/395; D06M 5/507; D06M 4/227
See application file for complete search history.

(56) References Cited

U.S. PATENT DOCUMENTS 3,762,872 A 10/1973 Acree
3,853,459 A 12/1974 Harper et al.
(Continued)

FOREIGN PATENT DOCUMENTS

EP 0474599 B1 4/1995
GB 2259525 3/1993
(Continued)

OTHER PUBLICATIONS

Beltrame et al., "Dyeing of Cotton in Supercritical Carbon Dioxide", Dyes and Pigments, vol. 39, Issue 4, Dec. 1, 1998, pp. 335-340.

(Continued)

*Primary Examiner* — Eisa B Elhilo
(74) *Attorney, Agent, or Firm* — Fish & Richardson P.C.

(57) ABSTRACT

A liquid fabric treatment composition including a hydrocarbon wax, a crosslinking agent, and a polyester warp sizing agent. The liquid fabric treatment composition may include a disperse dye. Methods of using these compositions for dyeing cellulose-containing fabric with a disperse dye include contacting a fabric containing cellulose with a liquid fabric treatment composition to yield a pretreated fabric, and heating the pretreated fabric to yield a treated fabric. The treated fabric contains a urethane compound formed by a reaction of the hydrocarbon wax, the crosslinking agent, and the cellulose of the fabric.

22 Claims, 2 Drawing Sheets

(51) Int. Cl.

| | |
|---|---|
| ***D06M 13/395*** | (2006.01) |
| ***D06M 15/507*** | (2006.01) |
| ***D06M 15/227*** | (2006.01) |

(56) References Cited

U.S. PATENT DOCUMENTS

| | | | |
|---|---|---|---|
| 5,199,956 | A | 4/1993 | Schlenker et al. |
| 5,250,078 | A | 10/1993 | Saus et al. |
| 5,298,032 | A | 3/1994 | Schlenker et al. |
| 5,578,088 | A | 11/1996 | Schrell et al. |
| 5,938,794 | A | 8/1999 | Eggers et al. |
| 5,953,780 | A | 9/1999 | Schollmeyer et al. |
| 5,958,085 | A | 9/1999 | Eggers et al. |
| 5,972,045 | A | 10/1999 | Eggers et al. |
| 6,010,542 | A | 1/2000 | DeYoung et al. |
| 6,048,369 | A | 4/2000 | Smith et al. |
| 6,083,565 | A | 7/2000 | Carbonell et al. |
| 6,224,774 | B1 | 5/2001 | DeSimone et al. |
| 6,261,326 | B1 | 7/2001 | Hendrix et al. |
| 6,537,327 | B2 | 3/2003 | Rodrigues |
| 6,598,252 | B2 | 7/2003 | Woerlee |
| 6,615,620 | B2 | 9/2003 | Hendrix et al. |
| 6,620,211 | B2 | 9/2003 | Veugelers et al. |
| 6,676,710 | B2 | 1/2004 | Smith et al. |
| 6,787,503 | B2 | 9/2004 | Suh |
| 7,053,131 | B2 | 5/2006 | Ko et al. |
| 7,731,763 | B2 | 6/2010 | Fernandez Cid et al. |
| 7,938,865 | B2 | 5/2011 | Fernandez Cid et al. |
| 8,439,982 | B2 | 5/2013 | Yager |
| 2005/0137274 | A1 | 6/2005 | Ko |
| 2006/0048308 | A1 | 3/2006 | Scheibli |
| 2007/0000076 | A1 | 1/2007 | Hall-Goulle et al. |
| 2007/0004849 | A1 | 1/2007 | Siemensmeyer et al. |
| 2010/0120309 | A1* | 5/2010 | Arnold ..... D06M 15/256 442/67 |
| 2011/0138547 | A1 | 6/2011 | Fernandez Cid et al. |
| 2012/0246842 | A1 | 10/2012 | Schoots et al. |
| 2013/0000057 | A1 | 1/2013 | Schoots |
| 2013/0136935 | A1* | 5/2013 | Sedillo ..... C08J 3/03 428/473 |
| 2013/0219635 | A1 | 8/2013 | Schoots et al. |
| 2014/0150187 | A1 | 6/2014 | Schoots |
| 2015/0052692 | A1 | 2/2015 | Lee |
| 2016/0168379 | A1* | 6/2016 | Lee ..... C08L 75/04 428/196 |

FOREIGN PATENT DOCUMENTS

| | | | |
|---|---|---|---|
| JP | 2003268682 | | 9/2003 |
| WO | WO93/14259 | A1 | 7/1993 |
| WO | WO94/09201 | A1 | 4/1994 |
| WO | WO2004016849 | | 2/2004 |
| WO | WO2006049504 | A2 | 5/2006 |
| WO | WO2014005685 | A1 | 1/2014 |
| WO | WO2014011278 | A9 | 1/2014 |
| WO | WO2014133384 | A1 | 9/2014 |
| WO | WO2016160771 | | 10/2016 |

OTHER PUBLICATIONS

"Ozcan et al., "Dyeing of Cotton Fibres with Dispere Dyes in Supercritical Carbon Dioxide", Dyes and Pigments, vol. 36, Issue 2, Feb. 1998, pp. 103-110."

International Search Report and Written Opinion in International Application No. PCT/US2018/038535, dated Sep. 13, 2018, 16 pages.

* cited by examiner

FABRIC TREATMENT COMPOSITIONS AND METHODS

CROSS-REFERENCE TO RELATED APPLICATION

This application claims the benefit of U.S. Application No. 62/523,619 entitled "FABRIC TREATMENT COMPOSITIONS AND METHODS" and filed on Jun. 22, 2017, which is incorporated by reference herein in its entirety.

TECHNICAL FIELD

This invention relates to liquid compositions for dyeing fibrous material.

BACKGROUND

Dyeing fabric containing cellulosic fibers is an important chemical industrial process that results in commercial textile products. The natural fibers such as wool and silk, which are cationic polyamide (protein) fibers, are typically dyed using water-soluble acid dyes containing anionic groups such as residues of sulfuric, carboxylic, or phosphoric acids. Hydrophilic cellulosic fibers such as cotton, flax, and linen contain hydroxyl groups (—OH) and can be dyed using water-soluble dyes, such as direct (substantive) dyes or reactive dyes. Direct dyes physically bond to the hydrophilic fiber, e.g., by forming hydrogen bonds with the —OH groups of the cellulosic substrate. Reactive dyes chemically react with the fiber, e.g., by forming covalent bonds with the —OH groups of the cellulose. In some instances, reactive dyes can also be applied to protein fibers such as wool and silk and to some synthetic polyamides such as nylon. Acrylic fibers (made, e.g., from acrylonitrile) may be dyed using basic dyes. Hydrophobic synthetic fibers, such as polyester and acetate fibers, are typically dyed with disperse dyes that are sparingly water-soluble and do not have reactive or ionizable groups in their structure.

SUMMARY

In a first general aspect, the present disclosure provides a liquid fabric treatment composition including a hydrocarbon wax; a crosslinking agent; and a polyester warp sizing agent.

In some embodiments, the liquid fabric treatment composition also includes an ultraviolet light inhibitor.

In some embodiments, the liquid fabric treatment composition also includes an anti-migrant.

In some embodiments, the liquid fabric treatment composition also includes a disperse dye.

In a second general aspect, the present disclosure provides a method of forming a liquid fabric treatment composition, the method including combining an aqueous solvent; a hydrocarbon wax, a crosslinking agent, and a polyester warp sizing agent, to form the liquid fabric treatment composition.

In some embodiments, the method also includes combining an ultraviolet inhibitor with the liquid fabric treatment composition.

In some embodiments, the method also includes combining an anti-migrant with the liquid fabric treatment composition.

In some embodiments, the method also includes combining a disperse dye with the liquid fabric treatment composition.

In some embodiments, the method also includes agitating the liquid fabric treatment composition to form a liquid dispersion.

In a third general aspect, the present disclosure provides a method of treating fabric, the method including: (i) contacting fabric containing cellulose with a liquid dispersion to yield a pretreated fabric, wherein the liquid dispersion includes: a hydrocarbon wax; a crosslinking agent; and a polyester warp sizing agent; and (ii) heating the pretreated fabric to yield a treated fabric, wherein the treated fabric contains a urethane formed by a reaction of the hydrocarbon wax, the crosslinking agent, and the cellulose.

In some embodiments, the heating of the pretreated fabric includes reaching a temperature greater than a melting temperature of the hydrocarbon wax.

In some embodiments, the heating of the pretreated fabric includes drying the pretreated fabric at a temperature of at least 150° C. to obtain the treated fabric.

In some embodiments, a moisture content in the treated fabric is about 2 wt. % or less.

In some embodiments, the method of treating fabric also includes dyeing the treated fabric with a disperse dye.

In some embodiments, dyeing the treated fabric includes contacting the treated fabric with the disperse dye to yield a dyed fabric.

In some embodiments, dyeing the treated fabric includes jet dyeing the fabric.

In some embodiments, dyeing the treated fabric includes supercritical $CO_2$ ($SCCO_2$) dyeing the fabric.

In some embodiments, the supercritical $CO_2$ ($SCCO_2$) dyeing includes heating the treated fabric in a range of 120° C. to 130° C.

In some embodiments, dyeing the treated fabric includes sublimation printing.

In some embodiments, sublimation printing includes heating the treated fabric at a temperature in a range of 130° C. to 210° C.

In certain embodiments, the liquid dispersion contains a disperse dye. In some cases, the liquid dispersion includes an anti-migrant. In certain cases, the method of treating fabric includes thermosoling the treated fabric to yield a dyed fabric.

Implementations of the first, second, third, and fourth general aspects may include one or more of the following features.

In some embodiments, the composition is an aqueous dispersion.

In some embodiments, the hydrocarbon wax is in a form of a dispersion.

In some embodiments, the amount of hydrocarbon wax is in the range of about 1% on weight of goods ("o.w.g.") to about 10% o.w.g.

In some embodiments, the hydrocarbon wax is polyethylene wax.

In some embodiments, the polyethylene wax is oxidized.

In some embodiments, the polyethylene wax is anionic.

In some embodiments, the polyethylene wax contains carboxyl groups.

In some embodiments, the polyethylene wax is a high density polyethylene wax.

In some embodiments, a melting point of the polyethylene wax is in a range of about 100° C. to about 150° C.

In some embodiments, the crosslinking agent is in a form of a dispersion.

In some embodiments, the amount of the crosslinking agent is in the range of about 0.1% o.w.g. to about 5% o.w.g.

In some embodiments, the crosslinking agent contains nonionic blocked isocyanate.

In some embodiments, the crosslinking agent reacts with the hydrocarbon wax and a cellulose-containing fabric to form a urethane.

In some embodiments, the polyester warp sizing agent is in a form of a dispersion.

In some embodiments, the amount of the polyester warp sizing agent is in the range of about 1% o.w.g. to about 10% o.w.g In some embodiments, the polyester warp sizing agent is an anionic polyester warp size.

In some embodiments, the polyester contains sulfate moieties.

In some embodiments, the polyester contains sulfated isophthalic acid monomer units.

In some embodiments, the polyester contains sulfated terephthalic acid monomer units.

In some embodiments, an amount of the ultraviolet light inhibitor is in the range of about 0.1% o.w.g. to about 5% o.w.g.

In some embodiments, an amount of the anti-migrant is in the range from about 0.1% o.w.g. to about 10% o.w.g.

In some embodiments, the anti-migrant contains an acrylamide.

In some embodiments, an amount of the disperse dye in the composition is in the range from about 0.1% o.w.g. to about 10% o.w.g.

In some embodiments, the fabric is a garment.

The compositions and methods described herein allow disperse dyeing of cotton, for example, by applying sublimation printing, supercritical $CO_2$ dyeing, and thermosoling techniques to cotton substrates. A typical protocol for dyeing cotton with direct or reactive dyes involves the use of a large amount of water, salt, and energy, and generates significant amount of chemical waste. Disperse dyeing advantageously eliminates or decreases the consumption of water in the cotton dyeing processes. Furthermore, disperse dyeing is more efficient than the conventional cotton-dyeing processes. For example, disperse dyeing is a salt-free process that allows reuse of the dyebath and leaves less dye in the effluent. Also, disperse dyeing allows for application of luminescent dyes to cotton and yields colors that are not typically obtained on this type of fabric by conventional processes.

Methods and materials are described herein for use in the present application; other, suitable methods and materials known in the art can also be used. The materials, methods, and examples are illustrative only and not intended to be limiting. All publications, patent applications, patents, and other references mentioned herein are incorporated by reference in their entirety. In case of conflict, the present specification, including definitions, will control.

Other features and advantages of the present application will be apparent from the following detailed description and figures, and from the claims.

DETAILED DESCRIPTION

Figure 1:
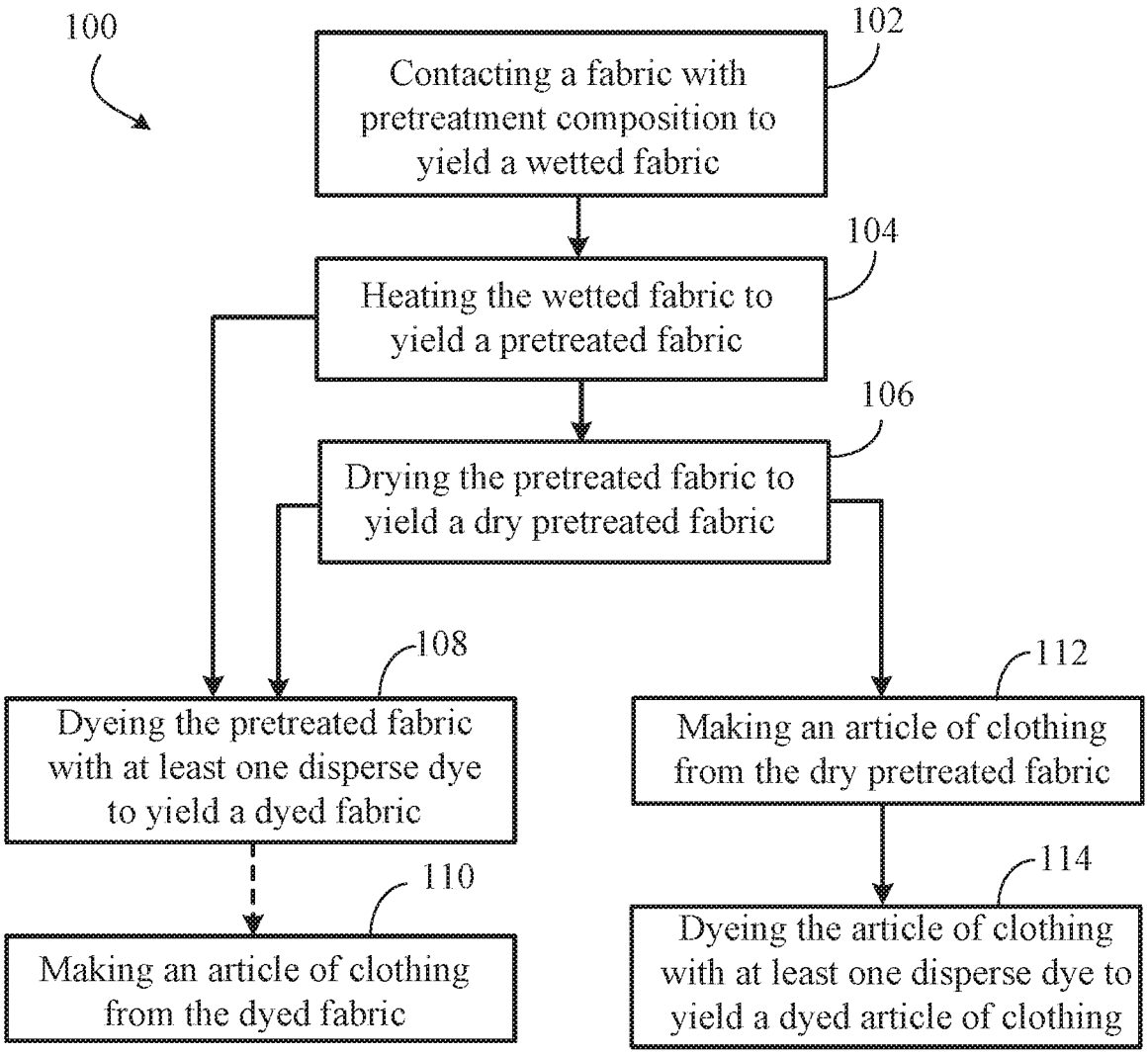
FIG. 1 is a flow chart for an exemplary method of pretreating a fabric with a liquid pretreatment composition to obtain a pretreated fabric, a dry pretreated fabric, an article of clothing prepared from a dry pretreated fabric, a fabric dyed with a disperse dye, or an article of clothing prepared form the dyed fabric.

Disperse dyes are an important class of dyes used in dyeing polyester fibers and other related materials such as nylon. Through their hydrophobic properties, these dyes are capable of penetrating into the similarly hydrophobic polyester fiber. The substantivity of the disperse dyes with respect to the polyester material allows for efficient diffusion of the disperse dyes into the polyester textiles. As used herein, the term "substantivity" refers to ability of a dye to be attracted by physical forces to a textile at the molecular level. The physical forces may include non-covalent bonding. Examples of non-covalent bonding include hydrogen bonds, electrostatic effects, π-effects, hydrophobic effects, and Van der Waals forces. The greater the attraction of the dye to the textile, the higher the substantivity of the dye to the textile.

Disperse dyes lack substantivity toward hydrophilic fibrous material and, therefore, disperse dyes are not typically used to dye cotton. The present disclosure provides liquid fabric treatment compositions that allow disperse dyeing of cotton. These compositions may be considered to be in two different general categories:

(1) pretreatment liquid compositions including a hydrocarbon wax, a crosslinking agent, and a polyester warp sizing agent. Such compositions may also contain an ultraviolet light inhibitor; and (2) liquid fabric treatment compositions including a pretreatment liquid composition of (1) and a disperse dye. Such compositions may also contain an anti-migrant.

Exemplary embodiments of the compositions, as well as the methods of making and using the compositions, are described herein. In one example, cotton fabric pretreated with the liquid composition of (1) may be further dyed with a disperse dye using conventional methods and apparatuses generally applicable to the disperse dyeing of polyester fabric, such as jet-dyeing. In another example, cotton fabric treated with the disperse dye-containing composition of (2) may be further thermosoled to provide the dyed cotton fabric.

Pretreatment Compositions

In some embodiments, the present disclosure provides a liquid fabric pretreatment composition including a hydrocarbon wax, a crosslinking agent, and a polyester warp sizing agent. Suitable examples of hydrocarbon waxes include oxidized high density polyethylene waxes. Suitable examples of crosslinking agents include blocked nonionic isocyanates. Suitable examples of polyester warp sizing agents include anionic polyester containing sulfated isophthalate or sulfated terephthalate monomer units. In some embodiments, the composition consists of a hydrocarbon wax, a crosslinking agent, and a polyester warp sizing agent. In other embodiments, the composition consists essentially of a hydrocarbon wax, a crosslinking agent, and a polyester warp sizing agent. In certain embodiments, the composition contains one or more additional components, as discussed herein. In one example, the composition includes an ultraviolet (UV) light inhibitor. Suitable examples of UV light inhibitors include benzophenone derivatives. In some embodiments, the composition is a liquid dispersion in an aqueous solvent. In one example, the composition is an aqueous dispersion.

As used herein, "dispersion" refers to a system consisting of particles of a dispersed phase (e.g., solid) and a continuous phase (e.g., liquid). Where the particle size of the dispersed phase is greater than about 1 μm, the dispersion is coarse, and where the particle size of the dispersed phase is between about 1 nm and 1 μm, the dispersion is a colloid. An emulsion is a suitable example of a coarse dispersion where the dispersed phase and the continuous phase are both liquid.

Fabrics

In some embodiments, the fabric suitable for pretreatment is hydrophilic. In one example, the fabric contains a polysaccharide such as cellulose, which contains hydroxyl groups.

As used herein, the term "cellulose" or "cellulosic" refers to a complex polysaccharide molecule that is composed of disaccharide subunits containing two D-glucopyranoses joined by 1,4'β-glycoside bond (e.g., 4-β-glucopyranosyl-D-glucopyranose).

As used herein, the term "hydroxyl" refers to an —OH moiety.

In some embodiments, the fabric contains at least one natural plant-based textile material. Suitable examples of natural plant-based textile material include cotton, linen, bamboo, hemp, jute and flax. In some embodiments, the fabric contains at least one natural animal-based textile material. Suitable examples of natural animal-based textile material include wool and silk.

In some embodiments, the fabric contains at least one synthetic fibrous material, for example, synthetic cellulosic fibrous material prepared from purified cellulose such as wood pulp. In one such example, the synthetic cellulosic fiber is rayon. Examples of rayon include viscose, modal, tensel, and lyocell. In another example, the synthetic fibrous material is polyester, polyamide, polyolefin, acrylonitrile, acrylic, or nylon. In some embodiments, the fabric is a blend of cellulosic fibrous material and synthetic material that does not contain cellulose. In one such example, the fabric is a blend of cotton and polyester. Suitable blends include 90/10, 80/20, 70/30, 65/35, 60/40, 50/50, 40/60, 35/65, 30/70, 20/80, and 10/90 cotton/polyester blends (w/w or v/v). In some embodiments, the fabric is a blend of cotton and viscose. Suitable examples of such blends include 90/10, 80/20, 70/30, 65/35, 60/40, 50/50, 40/60, 35/65, 30/70, 20/80 and 10/90 cotton/viscose blends (w/w or v/v). In some embodiments, the fabric is a blend of cotton and linen. Suitable examples of such blends include 90/10, 80/20, 70/30, 65/35, 60/40, 50/50, 40/60, 35/65, 30/70, 20/80 and 10/90 cotton/linen blends (w/w or v/v).

In some embodiments, the fabric contains cotton. In some embodiments, the fabric consists of cotton. In some embodiments, the fabric consists essentially of cotton. In some embodiments, the cotton contains from about 50 wt. % to about 100 wt. % cellulose.

Suitable ranges of cellulose in cotton include from about 60 wt. % to about 99 wt. %, from about 70 wt. % to about 95 wt. %, from about 75 wt. % to about 95 wt. %, from about 80 wt. % to about 95 wt. %, or from about 85 wt. % to about 95 wt. % cellulose. In some embodiments, cotton contains about 75 wt. %, about 80 wt. %, about 85 wt. %, about 90 wt. %, about 91 wt. %, about 92 wt. %, about 93 wt. %, about 94 wt. %, or about 95 wt. % cellulose. In some embodiments, the weight of fabric containing cotton is from about 50 g/m$^2$ to about 300 g/m$^2$, from about 60 g/m$^2$ to about 250 g/m$^2$, from about 75 g/m$^2$ to about 200 g/m$^2$, from about 100 g/m$^2$ to about 250 g/m$^2$, or from about 125 g/m$^2$ to about 150 g/m$^2$. In some embodiments, the weight of fabric containing cotton is about 125 g/m$^2$, about 135 g/m$^2$, about 140 g/m$^2$, about 145 g/m$^2$, about 150 g/m$^2$, about 155 g/m$^2$, about 160 g/m$^2$, about 165 g/m$^2$, about 175 g/m$^2$, about 200 g/m$^2$, or about 250 g/m$^2$.

In some embodiments, the cotton is bleached. In some examples, the cotton is bleached by any one of the conventional bleaching processes generally known in the art. In some embodiments, the cotton bleaching process is oxidative bleaching or reductive bleaching. In some embodiments, the bleached cotton is of commercial brightness.

In some embodiments, the cotton is raw cotton. In some embodiments, the cotton is greige cotton. The yarn of the cotton greige typically contains natural seed oils, wax and seed pigments. In some examples, greige cotton contains less than about 5 wt. % or less than about 10 wt. % of cottonseed oils, wax, and pigments.

In some embodiments, the cotton is scoured. For example, the cotton may be scoured by any one of the conventional scouring processes generally known in the art, using, for example, sodium carbonate and fabric detergent or liquid soap.

In some embodiments, the cotton is mercerized. For example, the cotton may be mercerized by any one of the conventional processes generally known in the art for mercerization of cotton, for example, by treating the cotton with sodium hydroxide followed by acidic treatment.

In some embodiments, the fabric is in the form of a woven textile material, non-woven textile material, or knitted textile material. In some embodiments, the fibrous material is a yarn or a filament. In some embodiments, the fabric is woven, and the weave of the woven fabric is selected from plain, poplin, oxford, pinpoint, fil-a-fil, twill, herringbone, dobby, flannel, seersucker, and satin, or a combination thereof.

As used herein, the term "goods" refers to materials prepared from the textile fibers. In one example, goods include woven or knitted cotton fabric.

Hydrocarbon Waxes

In some embodiments, the hydrocarbon wax in the fabric pretreatment composition is an animal wax, a plant wax, or a petroleum-derived wax. As used herein, "wax" refers to a ductile hydrophobic material that is solid at room temperature and has a melting point of at least about 35° C.

In some embodiments, the hydrocarbon wax in the fabric pretreatment composition is a petroleum-derived wax. One example of a petroleum-derived wax is paraffin wax. In some embodiments, the hydrocarbon wax contains long-chain hydrocarbons, such as alkanes and alkenes. In some embodiments, the hydrocarbon wax contains paraffins. Suitable examples of paraffins in the hydrocarbon wax include hentriacontane ($C_{31}H_{64}$). In certain embodiments, the hydrocarbon wax can contain one or more additional components. Examples of additional components in the hydrocarbon wax include fatty acids, fatty alcohols, and fatty esters. In some embodiments, the hydrocarbon wax contains esters of triacontanol and palmitic acid, cetyl palmitate, myricyl cerotate, lanolin, or mixtures thereof.

In some embodiments, the melting point of the hydrocarbon wax is in a range of about 40° C. to about 250° C., about 50° C. to about 250° C., about 60° C. to about 200° C., about 75° C. to about 185° C., about 100° C. to about 150° C., or about 120° C. to about 160° C.

In some embodiments, the hydrocarbon wax contains a polyolefin (polyalkylene). In some embodiments, the polyolefin is a copolymer or homopolymer of ethylene, propylene, 1-butene, 4-methyl-1-pentene, 3-methyl-1-butene, 4,4-dimethyl-1-pentene, 3-methyl-1-pentene, 4-methyl-1-hexene, 5-ethyl-1-hexene, 6-methyl-1-heptene, 1-hexene, 1-heptene, 1-octene, 1-nonene, 1-decene, and the like. In some examples, the polyalkylene is polypropylene or polyethylene. In some embodiments, the polyalkylene is linear or branched. For example, the polyalkylene can have from 2 to 100 termini (e.g., from 2 to 5, 4 to 6, 5 to 6, or 3 to 6 termini). In some embodiments, the polyalkylene is linear and therefore has 2 termini.

In some embodiments, the hydrocarbon wax consists of a polyethylene wax. In some embodiments, the hydrocarbon wax consists essentially of a polyethylene wax. In such embodiments, the polyethylene wax contains compounds of formula $(CH_2)_nH_2$, wherein n ranges from 20 to 200. Polyethylene wax may also include copolymers of ethylene with butene, hexene, octane, or other monomers that co-polymerize with ethylene to form polyethylene. In some embodiments, the polyethylene is homopolyethylene. In some embodiments, the polyethylene wax is a low density, linear low density, medium density, or high density wax. As used herein, "low density polyethylene" refers to polyethylene having a density from about 0.91 g/cm$^3$ to about 0.93 g/cm$^3$; "medium density polyethylene" refers to polyethylene having a density from about 0.93 g/cm$^3$ to about 0.94 g/cm$^3$; "high density polyethylene" refers to polyethylene having a density from about 0.94 g/cm$^3$ to about 0.97 g/cm$^3$. The low density, medium density, and high density polyethylene may be linear or branched. Linear polyethylene has 2 termini, while suitable examples of branched polyethylene include 2 to 5, 4 to 6, 5 to 6, or 3 to 6 termini.

In some embodiments, the polyethylene is high-density polyethylene (HDPE). In some embodiments, a density of the polyethylene in the composition ranges from about 0.91 g/cm$^3$ to about 1.2 g/cm$^3$, from about 0.92 g/cm$^3$ to about 1.1 g/cm$^3$, from about 0.93 g/cm$^3$ to about 0.97 g/cm$^3$, from about 0.93 g/cm$^3$ to about 1.05 g/cm$^3$, from about 0.93 g/cm$^3$ to about 0.99 g/cm$^3$, from about 0.93 g/cm$^3$ to about 0.98 g/cm$^3$, or from about 0.93 g/cm$^3$ to about 0.97 g/cm$^3$. The density of polyethylene may be measured, for example, according to ASTM D 1505-68. In some embodiments, the polyethylene wax has a molecular weight in the range of from about 100 g/mol to about 20,000 g/mol, from about 400 g/mol to about 15,000 g/mol, from about 600 g/mol to about 10,000 g/mol, or from about 800 g/mol to about 8,000 g/mol.

In some embodiments, the hydrocarbon wax is oxidized. Oxidation of the hydrocarbon wax may be carried out by any method generally known in the art. In one example, the oxidation procedure involves passing an oxygen-containing gas into or over the hydrocarbon wax in a solid or melted form at elevated temperature. Suitable examples of an oxygen-containing gas include oxygen, ozone, and mixtures thereof. In some embodiments, a catalyst may be used in the oxidation process. One example of a suitable catalyst is metallocene. Oxidation of the hydrocarbon generally leads to breakdown of the hydrocarbon backbone and formation of carboxyl functional groups on the wax. In some embodiments, the oxidized hydrocarbon wax is anionic. The degree of oxidation of the wax may be determined by the acid number of the product. As used herein, "acid number" refers to a number of milligrams of KOH required to neutralize 1 gram of the material (e.g., oxidized wax or an anionic polyester). In some embodiments, the oxidized hydrocarbon wax has an acid number from about 5 to about 50, from about 10 to about 40, from about 10 to about 35, from about 10 to about 30, or from about 14 to about 22.

In some embodiments, the oxidized hydrocarbon wax is emulsifiable (e.g., the carboxyl groups on the wax provide emulsifiability). That is, the oxidized wax may be combined with an aqueous solvent to form an emulsion by a process known in the art, such as a water-on-wax technique or a wax-on-water technique. The amount of water in the emulsion varies from about 10 wt. % to about 90 wt. %, from about 50 wt. % to about 70 wt. %, from about 60 wt. % to about 65 wt. %, or from about 10 wt. % to about 30 wt. %. In some embodiments, the amount of water in the hydrocarbon wax emulsion is about 20 wt. %. In other embodiments, the amount of water in the hydrocarbon wax emulsion is about 80 wt. %. In some embodiments, a base is added to the oxidized hydrocarbon wax prior to forming an emulsion, such that at least 25% of the carboxyl groups in the oxidized wax are converted to carboxylate ions. The base may be selected from NaOH and KOH. The amount of the base may range from about 1 wt. % to about 10 wt. %, from about 1 wt. % to about 8 wt. %, from about 2 wt. % to about 6 wt. %, or from about 3 wt. % to about 4 wt. %. One or more surfactants may also be combined with the emulsion.

In some embodiments, the hydrocarbon wax in the fabric pretreatment composition is an oxidized high density polyethylene wax. In such embodiments, the wax readily forms a dispersion when mixed with water. One example of such wax is Turpex ACN (available from Huntsman).

In some embodiments, after a fabric (e.g., cotton) is treated with the pretreatment composition, the hydrocarbon wax, when heated at or above the melting temperature of the wax, melts into the fabric and non-covalently binds to the fibers. Hydrocarbon wax has the long hydrocarbon chains, to which the hydrophobic disperse dyes may be substantive. In some embodiments, the long hydrocarbon chains in the wax promote the diffusion of the disperse dyes into the wax. Hydrocarbon wax is an amorphous material and is thus receptive to the disperse dye molecules. In some embodiments, the hydrocarbon wax in the pretreatment composition makes the fabric amenable to dying with disperse dyes.

Polyester Warp Sizing Agents

As used herein, the term "warp sizing" refers to a process of applying a protective adhesive coating upon the surface of a fabric to maintain good fabric quality by increasing smoothness, elasticity, frictional resistance, and absorbency of the fabric. A warp sizing agent is typically applied to textile strands or yarns to allow for smooth handling of the material during fabric formation processes such as weaving, to avoid damage to the textile. Natural hydrophilic fibers such as cotton may be sized using various hydrophilic polysaccharides such as starch, dextrin, carboxymethyl cellulose, hydroxyethyl cellulose, guar gum, alginates, and the like. These sizing agents are typically not suitable for use with hydrophobic synthetic fibers (e.g., polyester). Rather, polymeric hydrophobic sizing agents (e.g., polyacrylates, polyamides, polyesters) are commonly used to warp size polyester textiles. Nevertheless, a polyester warp sizing agent may be advantageously used in the pretreatment composition of the present disclosure for application to hydrophilic fabric substrates.

In some embodiments, a polyester warp sizing agent in a fabric pretreatment composition may contain any polyester backbone generally known in the art. In one example, a polyester backbone is prepared by polymerizing a diol and a dicarboxylic acid, or a dicarboxylic acid salt and an ester. In some embodiments, the diol may be a compound of formula HO—$C_{1-6}$alkylene-OH, a compound of formula HO—$C_{1-6}$ haloalkylene-OH, a compound of formula HO—$C_{3-7}$cycloalkylene-OH, or a compound of formula HO—$C_{6-12}$arylene-OH. As used herein, "alkylene" or "$C_{n-m}$ alkylene" are used interchangeably and refer to a divalent alkyl (e.g., $C_{n-m}$alkyl) linking group having n to m carbons (where n and m are independently selected from 1 to 10). The alkylene group may be linear or branched. Examples of alkylene groups include, but are not limited to, methylene, ethan-1,1-diyl, ethan-1,2-diyl, propan-1,1-diyl, propan-1,3-diyl, propan-1,2-diyl, butan-1,4-diyl, butan-1,3-diyl, butan-1,2-diyl, 2-methyl-propan-1,3-diyl, and the like. In some embodiments, the alkylene moiety contains 2 to 6, 2 to 4, 2 to 3, 1 to 6, 1 to 4, or 1 to 2 carbon atoms. The term "haloalkylene" refers to an alkylene group in which one or more of the hydrogen atoms are replaced with a halogen atom (e.g., F, Cl, Br or I). examples of haloalkylene group include difluoromethylene, tetrafluoroethylene and the like.

As used herein, the terms "cycloalkylene" and "$C_{n-m}$cycloalkylene" are used interchangeably and refer to divalent non-aromatic cyclic hydrocarbons including cyclized alkyl or alkenyl linking groups having n to m carbons (where n and m are independently selected from 3 to 10). Cycloalkylene groups can include mono- or polycyclic (e.g., having 2, 3, or 4 fused rings) groups and spirocycles. Ring-forming carbon atoms of a cycloalkylene group can be optionally substituted by oxo or sulfido (e.g., C(O) or C(S)). Also included in the definition of cycloalkylene are moieties that have one or more aromatic rings fused to (i.e., having a bond in common with) the non-aromatic cyclic hydrocarbon, for example, benzo or thienyl derivatives of cyclopentane, cyclohexane, and the like. A cycloalkylene group containing a fused aromatic ring can be attached through any ring-forming atom including a ring-forming atom of the fused aromatic ring. Cycloalkylene groups can have 3, 4, 5, 6, 7, 8, 9, 10, 11, or 12 ring-forming atoms. In some embodiments, the cycloalkylene is a 3-12 membered monocyclic or bicyclic cycloalkylene. In some embodiments, the cycloalkylene is a $C_{3-7}$ monocyclic cycloalkane-diyl. Example cycloalkylene groups include cyclopropane-1,2-diyl, cyclobutane-1,2-diyl, cyclobutane-1,3-diyl, cyclopentane-1,2-diyl, cyclopentane-1,3-diyl,cyclohexane-1,2-diyl, cyclohexane-1,3-diyl, cyclohexane-1,4-diyl, cycloheptylene, cyclopentenylene, cyclohexenylene, cyclohexadienylene, cycloheptatrienylene, norbornylene, norpinylene, norcarnylene, and the like. In some embodiments, cycloalkylene is cyclopropane-1,2-diyl, cyclobutane-1,2-diyl, cyclobutane-1,3-diyl, cyclopentane-1,2-diyl, cyclopentane-1,3-diyl, or cyclohexane-1,2-diyl. In some embodiments, the cycloalkylene is a 3-8 membered or 3-7 membered monocyclic cycloalkylene group (e.g., $C_{3-8}$ or $C_{3-7}$ cycloalkylene). In some embodiments, the cycloalkylene is an 8-12-membered bicyclic cycloalkylene. In some embodiments, the 8-12 membered bicyclic cycloalkylene is an 8-12 membered fused cycloalkylaryl-diyl group (such as indane-1,2-diyl) or a 8-12 membered fused cycloalkylheteroaryl-diyl group.

As used herein, the terms "arylene" and "$C_{n-m}$ arylene" are used interchangeably and refer to a divalent aromatic hydrocarbon group, which may be monocyclic or polycyclic (e.g., having 2, 3 or 4 fused rings or rings connected by a single covalent bond), where n and m are independently selected from 6 to 20. Arylene groups include, e.g., phenylene, naphthylene, anthracenylene, phenanthrenylene, indanylene, indenylene, and the like. In some embodiments, arylene groups have from 6 to about 20 carbon atoms, from 6 to about 15 carbon atoms, or from 6 to about 10 carbon atoms. In some embodiments, the arylene group is phenylene. In some embodiments, the arylene group is biphenylene. In some embodiments, the arylene group is naphthylene.

In some embodiments, the diol is ethylene glycol (HO—$CH_2CH_2$OH), 1,4-butanediol (HO—$(CH_2)_4$—OH), bisphenol A, propylene-1,3-diol (beta-propylene glycol, HO—$(CH_2)_3$—OH), resorcinol, methanediol ($H_2C(OH)_2$), $(F_3C)_2C(OH)_2$, propane-1,2-diol (alpha-propylene glycol, HO—$CH_2$—CH(OH)—$CH_3$), 2-methyl-2-propyl-1,3-propanediol, neopentyl glycol, 1,5-pentanediol, cyclohexane-1,2-diol (e.g., trans-1,2-cyclohexanediol, cis-1,2-cyclohexanediol), 1,2-cyclobutanediol, 1,3-cyclobutanediol, 2,2,4,4-tetramethyl-1,3-cyclobutanediol (CBDO), 1,2-cyclopropanediol, cyclopropane-1,1-diol, 1,2-cyclopentanediol, 1,3-cyclopentanediol, and the like. In some embodiments, the diol is ethylene glycol.

In some embodiments, the dicarboxylic acid may be a compound of formula HO—C(═O)—$C_{1-6}$ alkylene-C(═O)—OH, a compound of formula HO—C(═O)-$C_{1-6}$ haloalkylene-C(═O)—OH, a compound of formula HO—C(═O)—$C_{3-7}$ cycloalkylene-C(═O)—OH, or a compound of formula HO—C(═O)—$C_{6-12}$ arylene-C(═O)—OH. In some embodiments, the dicarboxylic acid is an aliphatic dicarboxylic acid such as adipic, sebacic, malonic, succinic, glutaric, pimelic, suberic, or azelaic acid. In some embodiments, the dicarboxylic acid is an aromatic dicarboxylic acid such as phthalic acid (o-phthalic acid), isophthalic acid (m-phthalic acid), terephthalic acid (p-phthalic acid), diphenic acid (biphenyl-2,2'-dicarboxylic acid), or 2,6-naphthalenedicarboxylic acid. In some embodiments, a salt or an ester of any one of the dicarboxylic acid compounds is used to prepare the polyester.

In some embodiments, any one of the diols or dicarboxylic acids described herein is substituted with 1, 2, 3, 4, or 5 moieties such as —S(═O)$_2$—OH, —C(═O)—OH, and —P(═O)$(OH)_2$. In some embodiments, the dicarboxylic acid is a compound of formula:

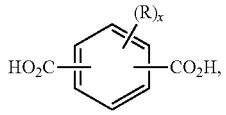

in which each R is independently —S(═O)$_2$—OH, —C(═O)—OH, or —P(═O)$(OH)_2$, or a salt or an ester of any one of these moieties, and x an integer of 1 to 4. In some embodiments, the dicarboxylic acid is a compound of formula:

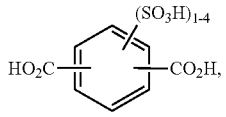

or a salt (e.g., Na or K salt) or an ester (e.g., methyl or ethyl ester) thereof.

In some embodiments, a polyester warp sizing agent in a fabric pretreatment composition is polyethylene terephthalate (PET), polytrimethylene terephthalate, polyhexamethylene adipate diol (PHA), poly(1,4-butylene adipate) diol, poly(3-methyl pentamethylene) adipate diol (PMPA), or polyneopentyl adipate diol (PNA). In some embodiments, the polyester warp sizing agent in the fabric pretreatment composition is produced from ethylene glycol and at least one dicarboxylic acid component such as isophthalic acid, trimellitic anhydride, terephthalic acid, and 5-sulfoisophthalic acid, or a salt or an ester of any of these acids. In one example, the polyester warp sizing agent is prepared from ethylene glycol, isophthalic acid, and 5-sulfoisophthalic acid, or an ester or salt thereof. In some embodiments, the polyester warp sizing agent in the fabric pretreatment composition includes anionic hydrophilic groups, such as sulfate groups. In one example, the polyester warp sizing agent contains sulfated isophthalic acid monomer units or sulfated terephthalic acid monomer units. In some embodiments, the polyester has an acid value of at least 5, at least 10, at least 20, or at least 30.

In some embodiments, the polyester warp sizing agent in the fabric pretreatment composition contains the maximum possible number of sulfated isophthalic acid groups in the polymer backbone. PW-600 (available from Ulterion) is a suitable example of a polyester that contains sulfated isophthalic acid groups in the polymer backbone.

After the fabric is treated with the pretreatment composition, the polyester warp sizing agent attracts the hydrophobic disperse dyes and enhances their ability to diffuse into the wax. The polyester binds to the hydrocarbon wax through hydrophobic interactions, thereby becoming non-covalently attached to the fabric.

Crosslinking Agents

In some embodiments, the crosslinking agent is a compound capable of chemically reacting with the material from which the fabric is made, and with the hydrocarbon wax or with the polyester warp sizing agent, thereby covalently bonding the fabric with the wax or the polyester. In one example, the crosslinker is a compound of general formula:

$$(RG)_n\text{-crosslinker-}(RG)_m,$$

where each RG is independently a reactive group such as —OH, halo, —C(═O)OH, —C(═O)Cl, —S(═O)$_2$OH, —S(═O)$_2$Cl, —N═C═O, —NH$_2$, —CN, or a similar reactive group; n and m is each independently an integer from 0 to 10 (e.g., 1, 2, 3, 4, 5, 6, or 7); and the -crosslinker-moiety is an alkylene, cycloalkylene, arylene, or a combination thereof. In one example, the -crosslinker- moiety is a combination of alkylene and arylene groups. Suitable examples of alkylene groups in the -crosslinker-moiety include optionally substituted methylene. Suitable examples of arylene groups in the -crosslinker-moiety include optionally substituted phenylene. In another example, the -crosslinker-moiety contains a polyalkylene glycol. Suitable examples of a polyalkylene alcohol in the -crosslinker-moiety include polyethylene glycol and polypropylene glycol. In some embodiments, the crosslinking agent in the fabric pretreatment composition is an isocyanate (e.g., polyisocyanate). In some embodiments, the isocyanate crosslinking agent contains at least one moiety of formula —N═C═O. In some embodiments, at least one moiety of formula —N═C═O is blocked, e.g., with an alcohol such as a polyol. The blocking may be achieved by reacting the isocyanate with an alcohol blocking agent under conditions known in the art. The reacting may be carried out until no free isocyanate groups are present. The blocking agents may be selected from alcohols such as methanol, ethanol, butanol, 2-butoxy ethanol, 2-(2-butoxyethoxy) ethanol, 2-hexoxyethanol, trimethylolpropane, ethylene glycol, propylene glycol, decyl alcohol, lauryl alcohol, and the like. In some embodiments, the crosslinking agent is 1,3-bis(1-isocyanato-l-methylethyl)benzene. In some embodiments, the 1,3-bis(1-isocyanato-1-methylethyl)benzene is blocked. In certain embodiments, the isocyanate crosslinker is blocked with a pyrazole.

In some embodiments, the crosslinking agent is nonionic. In some embodiments, the crosslinking agent is anionic.

In some embodiments, the crosslinking agent is 4,4'-diphenylmethane diisocyanate, toluene diisocyanate, hexamethylene diisocyanate (HDI), or a dimer, a trimer, or a polymer thereof. In some embodiments, the crosslinking agent is a di- or triisocyanate. In some examples, the isocyanate crosslinker is at least one of tetramethylene diisocyanate, cyclohexane 1,3- and 1,4-diisocyanate1-isocyanato-3,3,5-trimethyl-5-isocyanato-methylcyclohexane (isophorone diisocyanate, IPDI), methylene-bis(4-isocyanatocyclohexane), triisocyanatononane, triphenylmethane 4,4'-diisocyanate, naphthylene-1,5-diisocyanate, 4-isocyanatomethyloctane-1,8-diisocyanate (nonane triisocyanate, triisocyanatononane, TIN), and 1,6,11-undecane triisocyanate, or a dimer, a trimer, or a polymer of any of these compounds.

After the cotton fabric is treated with the pretreatment composition, the fabric is typically heated, for example, during the drying process. During the heating step, the blocking agent of the blocked isocyanate crosslinking agent is liberated, leaving the free isocyanate groups —N═C═O. These free isocyanate groups may react, for example, with the carboxyl groups of the oxidized hydrocarbon wax and the hydroxyl groups of the cellulose of the cotton fabric. The reaction of the isocyanate groups with the carboxyl groups of the wax and the hydroxyl groups of the fabric results in the formation of the covalent bonds, thereby increasing adhesion between the wax and the fabric. In some embodiments, the crosslinking agent reacts with the hydrocarbon wax and the cellulose-containing fabric to form a urethane, for example, as follows:

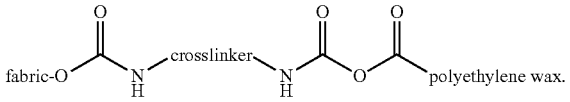

In some embodiments, the crosslinking agent in the fabric pretreatment composition is a nonionic blocked (poly)isocyanate. A suitable example of a nonionic blocked (poly) isocyanate includes Ruco-Coat FX 8041 (available from Rudolf Chemie).

UV Light Inhibitors

In some embodiments, the fabric pretreatment composition contains an ultraviolet (UV) light inhibitor. In some embodiments, the UV light inhibitor is a benzophenone derivative, a benzotriazole derivative, a triazine derivative, or a mixture thereof In some embodiments, the UV light inhibitor has a maximum absorbance ranging from 220 nm to 420 nm.

In some embodiments, the UV light inhibitor is a benzophenone derivative. Suitable examples of the benzophenone derivatives include 2,4-dihydroxybenzophenone, 2-hydroxy-4-methoxybenzophenone, 2-hydroxy-4-octyloxybenzophenone, 2-hydroxy-4-isooctyloxy benzophenone, 2-hydroxy-4-dodecyloxy benzophenone, 2,2'-dihydroxy-4-methoxybenzophenone, 2,2',4,4'-tetrahydroxy benzophenone, 2,2-dihydroxy-4,4'-dimethoxybenzophenone, 2-hydroxy-4-methoxy-5-sulfobenzophenone, and 2-hydroxy-4-benzyloxybenzophenone.

In some embodiments, the UV light inhibitor is a benzotriazole derivative. Suitable examples of the benzotriazole derivatives include 2-(2'-hydroxyphenyl) benzotriazole, 2-(2'-hydroxy-5-methylphenyl) benzotriazole, 2-(2'-hydroxy-3',5'-di-t-butylphenyl)-5-chlorobenzotriazole, 2-(2'-hydroxy-3'-sec-butyl-5'-methylphenyl) benzotriazole, 2-(2'-hydroxy-5'-octylphenyl) benzotriazole, 2-[2'-hydroxy-3',5'-(di-t-butyl) phenyl]benzotriazole, 2-[2'-hydroxy-3',5'-(di-t-amyl)phenyl]benzotriazole, 2-[2'-hydroxy-3',5'-di-(α,α-dimethylbenzyl)phenyl]benzotriazole, 2-(3'-t-butyl-2'-hydroxy-5' -methylphenyl)-5-chlorobenzotriazole, 2-(2'-hydroxy-3',5'-di-t-butyl)-5-chlorobenzotriazole, 2-(2'-hydroxy-5'-(1,1,3,3-tetramethylbutyl)phenyl) benzotriazole, 2-(2'-hydroxy-4'-octyloxyphenyl) benzotriazole, and 2-(2'-hydroxy-3',5'-di-t-amyl-phenyl) benzotriazole.

In some embodiments, the UV light inhibitor is a triazine derivative. Suitable examples of the triazine derivatives include 2,4,6-(triphenyl)-1,3,5-triazine, 2,4,6-tri(2-hydroxy-4-octyloxyphenyl)-1,3,5-triazine, 2(2-hydroxy-4-hexyloxy-phenyl)-4,6-bisphenyl)-1,3,5-triazine, 2-(2-hydroxy-4-octy-loxyphenyl)-4,6-bis(2,4-dimethylphenyl)-1,3,5-triazine, 2-(2,4-dihydroxyphenyl)-4,6-bis(2,4-dimethylphenyl)-1,3,5-triazine, 2,4-bis(2-hydroxy-4-propyl-oxyphenyl)-6-(2,4-dimethylphenyl)-1,3,5-triazine, 2-[2-hydroxy-4-octyloxy-phenyl)-4,6-bis(4-methylphenyl)-1,3,5-triazine, 2-(2-hydroxy-4-dodecyloxyphenyl)-4,6-bis(2,4-dimethylphenyl)-1,3,5-triazine, 2-(2-hydroxy-4-tridecyloxyphenyl)-4,6-bis (2,4-dimephenyl]-4,6-bis(2,4-dimethyl)-1,3,5-triazine, 2-[2-hydroxy-4-(2-hydroxy-3-octyloxypropyloxyoctyloxypropyloxy)-phenyl]-4,6-bis(2,4-dimethyl)-1,3,5-triazine, 2-[4-(dodecyloxy/tridecyloxy-2-hydroxypropoxy)-2-hydroxyphenyl]4,6-bis(2,4-dimethylphenyl)-1,3,5-triazine, 2-[2-hydroxy-4-(2-hydroxy-3-dodecyloxypropoxy)-phenyl]-4,6-bis(2,4-dimethyl-phenyl)-1,3,5-triazine, 2-(2-hydroxy-4-hexyloxy) phenyl-4,6-diphenyl-1,3,5-triazine, 2-(2-hydroxy-4-methoxyphenyl)-4,6-diphenyl-1,3,5-triazine, 2,4,6-tris[2-hydroxy-4-(3-butoxy-2-hydroxypropoxy)phenyl]-1,3,5-triazine, 2-(2-hydroxy-phenyl)-4-(4-methoxyphenyl)-6-phenyl-1,3,5-triazine, and 2-{2-hydroxy-4-[3-(2-ethylhexyl-1-oxy)-2-hydroxypropyloxy-phenyl}-4,6-bis-(2,4-dimethylphenyl)-1,3,5-triazine.

After the fabric is treated with the pretreatment composition and then dyed with the disperse dye, the UV light inhibitor provides enhanced light fastness to the fabric. Suitable examples of the UV light inhibitors include Fadex ECS (available from Archroma).

Pretreatment Composition

As used herein, "o.w.g." stands for "on weight of goods".

In some embodiments, an amount of the hydrocarbon wax in the pretreatment composition is in a range from about 0.1% o.w.g. to about 50% o.w.g, about 0.5% o.w.g. to about 40% o.w.g., from about 1% o.w.g. to about 30% o.w.g., from about 1% o.w.g. to about 20% o.w.g., from about 1% o.w.g. to about 10% o.w.g., or from about 1% o.w.g. to about 5% o.w.g. In some embodiments, an amount of the hydrocarbon wax in the pretreatment composition is in a range from about 0.1 wt. % to about 50 wt. %, from about 0.5 wt. % to about 40 wt. %, from about 1 wt. % to about 30 wt. %, from about 1 wt. % to about 20 wt. %, from about 1 wt. % to about 10 wt. %, or from about 1 wt. % to about 5 wt. %. In some embodiments, amount of the hydrocarbon wax in the pretreatment composition is about 0.5 wt. %, about 1 wt. %, about 3 wt. %, about 5 wt. %, about 7 wt. %, about 10 wt. %, or about 20 wt. %.

In some embodiments, amount of the polyester warp sizing agent in the pretreatment composition is in the range from about 0.1% o.w.g. to about 50% o.w.g., from about 0.5% o.w.g. to about 40% o.w.g., from about 1% o.w.g. to about 30% o.w.g., from about 1% o.w.g. to about 20% o.w.g., from about 1% o.w.g. to about 10% o.w.g., or from about 1% o.w.g. to about 5% o.w.g. In some embodiments, amount of the polyester warp sizing agent in the pretreatment composition is in the range from about 0.1 wt. % to about 50 wt. %, from about 0.5 wt. % to about 40 wt. %, from about 1 wt. % to about 30 wt. %, from about 1 wt. % to about 20 wt. %, from about 1 wt. % to about 10 wt. %, or from about 1 wt. % to about 5 wt. %. In some embodiments, amount of the polyester warp sizing agent in the pretreatment composition is about 0.5 wt. %, about 1 wt. %, about 3 wt. %, about 5 wt. %, about 7 wt. %, about 10 wt. %, or about 20 wt. %.

In some embodiments, an amount of the crosslinking agent in the pretreatment composition is in a range from about 0.01% o.w.g. to about 50% o.w.g., from about 0.05% o.w.g. to about 40% o.w.g., from about 0.1% o.w.g. to about 30% o.w.g., from about 0.1% o.w.g. to about 20% o.w.g., from about 0.1% o.w.g. to about 10% o.w.g., or from about 0.1% o.w.g. to about 5% o.w.g. In some embodiments, an amount of the crosslinking agent in the pretreatment composition is in a range from about 0.01 wt. % to about 50 wt. %, from about 0.05 wt. % to about 40 wt. %, from about 0.1 wt. % to about 30 wt. %, from about 0.5 wt. % to about 20 wt. %, from about 1 wt. % to about 10 wt. %, or from about 1 wt. % to about 5 wt. %. In some embodiments, an amount of the crosslinking agent in the pretreatment composition is about 0.1 wt. %, 0.5 wt. %, about 1 wt. %, about 1.5 wt. %, about 3 wt. %, about 5 wt. %, about 7 wt. %, about 10 wt. %, or about 20 wt. %.

In some embodiments, an amount of UV light inhibitor in the pretreatment composition is in a range from about 0.01% o.w.g. to about 50% o.w.g., from about 0.05% o.w.g. to about 40% o.w.g., from about 0.1% o.w.g. to about 30% o.w.g., from about 0.1% o.w.g. to about 20% o.w.g., from about 0.1% o.w.g. to about 10% o.w.g., or from about 0.1% o.w.g. to about 5% o.w.g. In some embodiments, an amount of UV light inhibitor in the pretreatment composition is in the range from about 0.01 wt. % to about 50 wt. %, from about 0.05 wt. % to about 40 wt. %, from about 0.1 wt. % to about 30 wt. %, from about 0.5 wt. % to about 20 wt. %, from about 1 wt. % to about 10 wt. %, or from about 1 wt. % to about 5 wt. %. In some embodiments, an amount of UV light inhibitor in the pretreatment composition is about 0.1 wt. %, about 0.5 wt. %, about 1 wt. %, about 1.5 wt. %, about 2 wt. %, about 2.5 wt. %, about 3 wt. %, about 5 wt. %, about 7 wt. %, about 10 wt. %, or about 20 wt. %.

In some embodiments, the pretreatment composition includes a hydrocarbon wax in an amount of about 1% o.w.g. to about 10% o.w.g., a polyester warp sizing agent in an amount of about 1% o.w.g. to about 10% o.w.g., and a crosslinking agent in an amount of about 0.1% o.w.g. to about 5% o.w.g. In some embodiments the pretreatment composition includes a hydrocarbon wax in an amount of about 1 wt. % to about 10 wt. %, a polyester warp sizing agent in an amount of about 1 wt. % to about 10 wt. %, and a crosslinking agent in an amount of about 1 wt. % to about 5 wt. %.

In some embodiments, the pretreatment composition contains an aqueous solvent. As used herein, the term "aqueous solvent" refers to a liquid containing at least 50%, at least 60%, at least 70%, at least 90%, or at least 95% water by volume. In some embodiments, the aqueous solvent is water. In some embodiments, the amount of the aqueous solvent in the composition is sufficient to produce a dispersion.

Optional Additives

In some embodiments, the fabric pretreatment composition contains at least one additive such as a dispersing agent, a surfactant, a plasticizer, a defoamer, a deflocculant, an emulsifier, a pH stabilizer, a wetting agent, a penetration enhancer, or an absorption enhancer. Any of the dispersing agents, surfactants, plasticizers, defoamers, deflocculants, emulsifiers, wetting agents, absorption and penetration enhancers generally known to be applicable in the dyeing industry and capable of ensuring the stability of the aqueous dispersion may be used in a fabric pretreatment composition.

In some embodiments, the dispersing agent is anionic. In some embodiments, the dispersing agent is a lignosulfonate. In some embodiments, the dispersing agent is a surfactant, such as polyoxyethylenated straight chain alcohol, nonylphenolethoxylate, ethoxylated sorbitan monolaurate, or ethoxylated sorbitan monostearate. In some embodiments, the surfactant includes at least one of ARKOPAL N-300, BRU 30, BRU 35, BRIJ 56, BRU 58, EGE Coco, EGE No. 10, GENAPOL X-150, TERGITOL NP-10, MARLIPAL 013/90, PLURONIC PE6400, SAPOGENAT T-300, T-MAZ 60K, T-MAZ 20, TRITON X-45, TRITON X-100, TRITON X-102, TRITON X-114, TRITON X-165, or TWEEN 80. In some embodiments, the surfactant includes at least one of sodium lauryl sulfate, cocamidopropyl betaine, ethoxylated nonylphenol, lauric acid diethanolamide, diethanolamine, polyethoxylated linear secondary alcohol, polyethoxylated tallow amine, poly(ethylene glycol) monooleate, and coconut oil monoethanolamide. In some embodiments, the fabric pretreatment composition is dispersant-free. In some embodiments, the emulsifier is a polyol such as propylene glycol, or an oleic acid sorbitan monoester.

In some embodiments, an amount of each additive in the fabric pretreatment composition is in a range from about 0.01% o.w.g. to about 50% o.w.g., from about 0.05% o.w.g. to about 40% o.w.g., from about 0.1% o.w.g. to about 30% o.w.g., from about 0.1% o.w.g. to about 20% o.w.g., from about 0.1% o.w.g. to about 10% o.w.g., or from about 0.1% o.w.g. to about 5% o.w.g. In some embodiments, an amount of the at least one additional ingredient in the pretreatment composition is in a range from about 0.01 wt. % to about 50 wt. %, from about 0.05 wt. % to about 40 wt. %, from about 0.1 wt. % to about 30 wt. %, from about 0.1 wt. % to about 20 wt. %, from about 0.1 wt. % to about 10 wt. %, from about 0.1 wt. % to about 5 wt. %, or from about 0.1 wt. % to about 1 wt. % (based on the weight of the composition). In some embodiments, an amount of each additive in the pretreatment composition is about 0.1 wt. %, about 0.5 wt. %, about 1 wt. %, about 1.5 wt. %, about 3 wt. %, or about 5 wt. %.

Fabric Treatment Disperse Dye-Containing Compositions

In some embodiments, the present disclosure provides a liquid fabric treatment composition containing a hydrocarbon wax, a crosslinking agent, a polyester warp sizing agent, and a disperse dye. In some embodiments, the liquid fabric treatment composition consists of an aqueous solvent, a hydrocarbon wax, a crosslinking agent, a polyester warp sizing agent, and a disperse dye. In other embodiments, the liquid fabric treatment composition consists essentially of a hydrocarbon wax, a crosslinking agent, a polyester warp sizing agent, and a disperse dye. In some embodiments, the composition includes an ultraviolet (UV) light inhibitor. In certain embodiments, the composition includes one or more optional additives. In one example, the composition includes an anti-migrant. In some embodiments, the composition is a liquid dispersion in an aqueous solvent (e.g., the composition is an aqueous dispersion).

Examples of fabrics suitable for treatment with the dye-containing composition, and examples of suitable hydrocarbon waxes, polyester warp sizing agents, crosslinking agents, UV light inhibitors, and optional additional additives include those described herein with respect to the pretreatment compositions.

Disperse Dyes

In some embodiments, the disperse dye in the fabric treatment composition is hydrophobic. In some embodiments, the disperse dye is nonionic. In some embodiments, the disperse dye has substantivity toward the hydrocarbon wax or the polyester warp sizing agent. In some embodiments, the disperse dye is water insoluble or sparingly water-soluble. In some embodiments, the disperse dye is used for dyeing fabric in the presence of a dispersing agent. In some embodiments, the dye is free of a dispersant. In one example, a dispersant-free composition incudes less than about 0.1 wt. % of a dispersant. In some embodiments, the dispersant-free composition includes less than about 0.01 wt. % of a dispersant.

In some embodiments, the disperse dye is a class A-D dye according to the ICI classification. In some embodiments, the disperse dye has low, medium, or high molecular weight. As used herein, the term "low molecular weight disperse dye" refers to a low energy disperse dye for dyeing fabric at a temperature of at least 77° C. In some embodiments, the low molecular weight dyes are poorly resistant to sublimation. As used herein, the term "medium molecular weight disperse dye" refers to a medium energy disperse dye for dyeing fabric at a temperature in the range of about 104° C.-110° C. In some embodiments, the medium molecular weight disperse dye provides better sublimation fastness than the low molecular weight dye. As used herein, the term "high molecular weight disperse dye" refers to a high energy dye for dyeing fabric at a temperature of at least 129° C. In some embodiments, the high molecular weight dye is suitable for continuous dyeing and provides fastness properties superior to the fastness properties provided by the medium molecular weight dye.

In some embodiments, the disperse dye is a substituted azo, anthraquinone, or diphenylamine compound. In some embodiments, the disperse dye is a nitroarylamino disperse dye, a coumarin disperse dye, a methine disperse dye, a naphthostyryl disperse dye, a quinophthalone disperse dye, a formazan disperse dye, or a benzodifuranone disperse dye. In some embodiments, a disperse dye of any color may be used in the present compositions.

Suitable examples of the azo disperse dyes include C.I Disperse Yellow 3, C.I Disperse Orange 25, C.I Disperse Red 167, C.I Disperse Violet 33, and C.I Disperse Blue 79. Suitable examples of the anthraquinone disperse dyes include C.I. Disperse Violet 4, C.I. Disperse Red 15, C.I. Disperse Red 60, and C.I. Disperse Violet 26.

In some embodiments, suitable examples of the disperse dyes include C.I. Disperse Red 92, C.I. Disperse Red 229, C.I. Disperse Blue 60, C.I. Disperse Blue 87, C.I. Disperse Blue 56, C.I. Disperse Yellow 114, C.I. Disperse Yellow 211, C.I. Disperse Yellow 54, C.I. Disperse Orange 30, C.I. Disperse Orange 31, C.I. Disperse Orange 44, C.I. Disperse Orange 61, C.I. Disperse Red 50, C.I. Disperse Red 73, C.I. Disperse Red 82, C.I. Disperse Red 324, C.I. Disperse Red 356, C.I. Disperse Red 376, C.I. Disperse Red 382, C.I. Disperse Red 383, C.I. Disperse Violet 93, C.I. Disperse Violet 107, C.I.

Disperse Blue 56, C.I. Disperse Blue 93, Disperse Blue 165, C.I. Disperse Blue 183, C.I. Disperse Blue 284, C.I. Disperse Blue 291, C.I. Disperse Blue 337, C.I. Disperse Blue 354, C.I. Disperse Blue 378, C.I. Disperse Green 9, C.I. Disperse Green 6, C.I. Disperse Green 5, C.I. Disperse Green 1, and C.I. Disperse Green 2.

In some embodiments, the disperse dye is C.I. Disperse Red 92, C.I Disperse Blue 79, C.I. Disperse Blue 291, or C.I. Disperse Orange 30.

Dye-Containing Compositions

In some embodiments, the liquid dye-containing fabric treatment composition contains a hydrocarbon wax, a polyester warp sizing agent, a crosslinking agent, and optionally a UV light inhibitor in the amounts described herein with respect to the pretreatment compositions.

In some embodiments, an amount of disperse dye in the composition is in a range from about 0.01% o.w.g. to about 50% o.w.g., from about 0.05% o.w.g. to about 40% o.w.g., from about 0.1% o.w.g. to about 30% o.w.g., from about 0.1% o.w.g. to about 20% o.w.g., or from about 0.1% o.w.g. to about 10% o.w.g. In some embodiments, an amount of disperse dye in the composition is in a range from about 0.01 wt. % to about 50 wt. %, from about 0.05 wt. % to about 40 wt. %, from about 0.1 wt. % to about 30 wt. %, from about 0.5 wt. % to about 20 wt. %, from about 1 wt. % to about 10 wt. %, or from about 1 wt. % to about 5 wt. %. In some embodiments, an amount of disperse dye in the composition is about 0.1 wt. %, about 0.5 wt. %, about 1 wt. %, about 1.5 wt. %, about 2 wt. %, about 2.5 wt. %, about 3 wt. %, about 5 wt. %, about 7 wt. %, about 10 wt. %, or about 20 wt. % (based on the weight of the composition).

In some embodiments, a liquid dye-containing fabric treatment composition includes a hydrocarbon wax in an amount of about 1% o.w.g. to about 10% o.w.g., a polyester warp sizing agent in an amount of about 1% o.w.g. to about 10% o.w.g., a crosslinking agent in an amount of about 0.1% o.w.g. to about 5% o.w.g., and a disperse dye in an amount of about 0.1% o.w.g. to about 10% o.w.g. In some embodiments, a liquid dye-containing fabric treatment composition includes a hydrocarbon wax in an amount of about 1 wt. % to about 10 wt. %, a polyester warp sizing agent in an amount of about 1 wt. % to about 10 wt. %, a crosslinking agent in an amount of about 1 wt. % to about 5 wt. %, and a disperse dye in an amount from about 1 wt. % to about 10 wt. % (based on the weight of the composition).

Optional Additives

In some embodiments, the liquid dye-containing fabric treatment composition optionally contains at least one additional ingredient. Exemplary additional ingredients and their amounts include those described herein with respect to the pretreatment compositions.

In some embodiments, the liquid dye-containing fabric treatment composition includes an anti-migrant. Anti-migrants promote uniform color distribution, inhibit dye migration during the dyeing process, and control the dye penetration into the fabric, film forming, and thickening, and impart non-tackiness to the dye composition. In some embodiments, the anti-migrant is a polyacrylic acid-based migration inhibitor or vinyl acetate-based migration inhibitor. In some embodiments, the anti-migrant contains an acrylamide. In some embodiments, the anti-migrant is sodium alginate based. In some embodiments, the anti-migrant is anionic, cationic, or nonionic. In some embodiments, the anti-migrant is suitable for thermosol dyeing of polyester fabric. In some embodiments, the anti-migrant is natural or synthetic. In some embodiments, the anti-migrant is carboxymethylcellulose, SOLIDOKOLL, guar gum, PMS-100 (acrylic acid copolymer), THERMOCOL MIN, THERMOCOL MP, or PRIMASOL FFAM.

In some embodiments, an amount of the anti-migrant in the composition is in a range from about 0.01% o.w.g. to about 50% o.w.g, from about 0.05% o.w.g. to about 40% o.w.g, from about 0.1% o.w.g. to about 30% o.w.g, from about 0.1% o.w.g. to about 20% o.w.g, from about 0.1% o.w.g. to about 10% o.w.g, or from about 0.1% o.w.g. to about 5% o.w.g. In some embodiments, an amount of the anti-migrant in the composition is in a range from about 0.01 wt. % to about 50 wt. %, from about 0.05 wt. % to about 40 wt. %, from about 0.1 wt. % to about 30 wt. %, from about 0.5 wt. % to about 20 wt. %, from about 0.5 wt. % to about 10 wt. %, from about 0.5 wt. % to about 5 wt. %, or from about 0.5 wt. % to about 2 wt. %. In some embodiments, an amount of the anti-migrant in the composition is about 0.1 wt. %, about 0.5 wt. %, about 1 wt. %, about 1.5 wt. %, about 2 wt. %, about 2.5 wt. %, about 3 wt. %, or about 5 wt. % (based on the weight of the composition).

Methods of Making the Compositions

Pretreatment Composition

In some embodiments, a pretreatment composition is prepared by combining a crosslinking agent, a hydrocarbon wax, a polyester warp sizing agent, and an aqueous solvent in a reaction vessel. In some embodiments, combining the components includes agitation, stirring, or shaking. In some embodiments, the components are combined at room temperature.

In some embodiments, a crosslinking agent is combined with water to form a first mixture, followed by combining a hydrocarbon wax with the first mixture to form a second mixture, followed by combining a polyester warp sizing agent with the second mixture to form the pretreatment composition.

In other embodiments, a hydrocarbon wax is combined with water to form a first mixture, followed by combining a crosslinking agent with the first mixture to form a second mixture, followed by combining a polyester warp sizing agent with the second mixture to form the pretreatment composition.

In yet other embodiments, a polyester warp sizing agent is combined with water to form a first mixture, followed by combining a hydrocarbon wax with the first mixture to form a second mixture, followed by combining a crosslinking agent with the second mixture to form the pretreatment composition.

In some embodiments, combining the components is carried out for a length of time of about 5 minutes to about 2 hours. In some embodiments, a UV light inhibitor is further added to the pretreatment composition. In some embodiments, combining the components yields an aqueous dispersion. In some embodiments, the dispersion is stable. In one example, the dispersion is stable for at least 2-24 hours.

In some embodiments, each of the components of the pretreatment composition is combined in a form of an aqueous dispersion. In one example, an aqueous dispersion of a hydrocarbon wax, an aqueous dispersion of a crosslinking agent, an aqueous dispersion of a polyester warp sizing agent, and an aqueous dispersion of a UV light inhibitor are combined to yield the pretreatment composition.

Dye-Containing Fabric Treatment Composition

In some embodiments, to prepare a dye-containing fabric treatment composition, a disperse dye is combined with a pretreatment composition prepared as described herein. In some embodiments, an anti-migrant is combined with a dye-containing fabric treatment composition. The combining may be carried out with agitation or stirring, at about room temperature. In some embodiments, the combining yields a stable dispersion.

Methods of Treating Fabric

Fabric Treatment with Pretreatment Compositions

FIG. 1 is a flow chart showing operations in exemplary process 100 for treating fabric with a pretreatment composition. In 102, fabric is contacted with a liquid pretreatment composition to yield a wetted fabric. The terms "wet," "moisten," and "dampen" are used interchangeably.

In some embodiments, dampening the fabric with the pretreatment composition is carried out using conventional padding equipment. Suitable examples of the conventional padding equipment include vessels, apparatuses, and machinery used in batch fabric dyeing. In some examples, equipment used in the padding process includes at least one fabric batch roll, at least one pad liquor trough, squeezing mangles, and a dryer unit. In some embodiments, wetting the fabric with the pretreatment composition is carried out by providing the pretreatment composition to a pad liquor trough and padding the fabric with the liquor at about 100% wet pick-up.

As used herein, the term "wet pick-up" (WPU) refers to the ratio of the weight of the liquid composition picked up by the fabric to the weight of the dry fabric prior to contacting the fabric with the liquid composition. In some embodiments, WPU is expressed as a fraction of 100. For example, a WPU of 100% refers to a 1/1 ratio of the weight of the liquid composition picked up by the fabric to the weight of the dry fabric.

In some embodiments, the padding is carried out at about 80% to about 200% WPU, about 90% to about 175% WPU, about 95% to about 160% WPU, about 100% to about 150% WPU, or about 100% to about 150% WPU. In some embodiments, the padding is carried out at about 80% WPU, about 90% WPU, about 100% WPU, about 110% WPU, about 120% WPU, about 130% WPU, about 140% WPU, about 150% WPU, or about 200% WPU.

In 104, the wetted fabric is heated to yield a pretreated fabric. In some embodiments, the pretreated fabric contains a urethane formed by reaction of the hydrocarbon wax, the crosslinking agent, and the cellulose in the fabric. In some embodiments, the pretreated fabric is a garment (e.g., any article of clothing described herein).

In some embodiments, the wetted fabric is heated in a dryer unit at a temperature greater than a melting temperature of the hydrocarbon wax in the pretreatment composition to yield the pretreated fabric. At this temperature, the hydrocarbon wax melts and diffuses into the fabric and non-covalently bonds to the fabric. A blocked isocyanate crosslinking agent present in the pretreatment composition is unblocked at this temperature and reacts with the carboxyl groups of the oxidized hydrocarbon wax and the hydroxyl groups of the cellulose backbone of the fabric, thus forming a urethane compound and covalently linking the fabric and the hydrocarbon wax. In some embodiments, the temperature in the dryer unit is about 150° C. In some embodiments, the temperature in the dryer unit is in the range of about 100° C. to about 200° C., about 120° C. to about 180° C., or about 140° C. to about 160° C.

The pretreated fabric from 104 may be dried further in 106 to yield a dry pretreated fabric, or may be dyed in 108 with a disperse dye before drying is complete. In some embodiments, the dried fabric in 106 is dyed with a disperse dye in 108. In 110, an article of clothing may be made from the dyed fabric of 108. In some embodiments, the dry pretreated fabric from 106 may be made into an article of clothing in 112, and the article of clothing may be dyed in 114.

In 106, heating is conducted for a period of time that is sufficient to dry the pretreated fabric. In some embodiments, the residual moisture content in the dry pretreated fabric is at most 2 wt. %, at most 1 wt. %. or at most 0.5 wt. %. In some embodiments, the dryer unit is an oven. In some embodiments, the heating is conducted by drum-drying, tumble-drying, hot air drying, infra-red drying, or hot flue drying.

In 108, the pretreated fabric is dyed using at least one disperse dye. The dyeing process includes contacting the pretreated fabric with a disperse dye to yield the dyed fabric. The dyeing of the treated fabric may be carried out using jet dyeing, carrier dyeing, supercritical carbon dioxide ($SCCO_2$) dying or sublimation printing. Jet dyeing may be carried out using jet-dyeing processes and machines that are conventional in the polyester dyeing field. In the jet-dyeing, the treated fabric is dyed at a temperature of about 130° C. In some embodiments, the temperature is in the range of about 100° C. to about 200° C., about 110° C. to about 170° C., or about 120° C. to about 150° C. In some embodiments, the dyeing temperature is sufficient for the disperse dye to diffuse into the hydrocarbon wax. In other embodiments, the dyeing temperature is sufficient for the disperse dye to diffuse into the polyester warp sizing agent. In some embodiments, jet dyeing is followed by scouring the water-dyed fabric at about 40° C. (without an afterclear) to provide the fabric dyed with the disperse dye.

Carrier dyeing may be carried out using carrier solvents used for dyeing polyester fabric. Common polyester dyeing carriers include butyl benzoate, methylnaphthalene, dichlorobenzene, diphenyl and o-phyenylphenol. The carrier dyeing is carried out at the boiling point of the carrier solvent for a period of time sufficient to allow the hydrocarbon wax in the pretreated fabric to absorb the carrier and swell, thereby allowing the diffusion of the dye into the hydrocarbon wax. In some embodiments, the carrier drying is followed up by hot air-drying the dyed goods at about 150-180° C.

Supercritical carbon dioxide ($SCCO_2$) dying may be carried out under high pressure and elevated temperature conditions at which $CO_2$ liquefies and solubilizes a disperse dye. The resultant solution of disperse dye in liquid $CO_2$ may be used to contact the pretreated fabric with a disperse dye, as an alternative to the aqueous disperse dye solutions used in jet dyeing. In some embodiments, $SCCO_2$ dyeing may be carried out in a stainless steel vessel equipped with a net or a grid for holding a pretreated fabric and a pressure valve. In some embodiments, the vessel is an autoclave. A disperse dye may be placed at the bottom of the vessel, and a pretreated fabric (e.g., dry fabric produced in 106 or wetted fabric produced in 104) may be placed on the net or grid inside the vessel. $CO_2$ may then be introduced into the vessel in a liquid phase from a cylinder or in a solid form as dry ice. In some embodiments, an amount of dye in the vessel is in a range from about 0.1% o.w.g to about 1% o.w.g. In one example, an amount of dye in the vessel is about 0.4% o.w.g. The vessel may be sealed and heated to a dyeing temperature in a range of about 80° C. to about 140° C., or about 120° C. to about 130° C., at which time $CO_2$ is isothermally compressed to become a supercritical fluid at a working pressure in the range of about 100 bar to about 350 bar, or about 200 bar to about 250 bar. In some embodiments, the liquor ratio of the pretreated fabric to the $SCCO_2$ fluid is in the range of about 1:1 to about 1:10. In one example, the liquor ratio is 1:8. In some embodiments, the density of $SCCO_2$ is about 505 $kg/m^3$.

Supercritical fluids are characterized by lower viscosity as compared to common liquid solvents (e.g., water). As a consequence, diffusion processes in $SCCO_2$ are facilitated, thus promoting uptake of disperse dyes by the pretreated fabric. In some embodiments, contacting the pretreated fabric with $SCCO_2$ promotes transition of the fabric to a rubbery state, lowers the transition glass temperature of the hydrocarbon wax, and promotes diffusion of the disperse dye into the fabric. In some embodiments, the $SCCO_2$ dyeing of the pretreated fabric may be carried out for a length of time in the range of about 30 min to about 60 minutes. Upon release of the pressure at the end of the treatment in the supercritical fluid, adsorbed $CO_2$ rapidly diffuses out of the fabric. The use of $SCCO_2$ instead of water advantageously avoids the step of drying the dyed fabric (e.g., when the pre-treated fabric is jet-dyed in 108), and is an energy efficient and eco-friendly process which does not produce hazardous wastewater. In some embodiments, the $SCCO_2$ dyeing is performed without rinsing the dyed fabric with acetone or water after dyeing.

Sublimation printing may be carried out at a sublimation temperature of a disperse dye (e.g., a temperature from about 130° C. to about 210° C.). In some embodiments, sublimation printing is carried out by applying a disperse dye to transfer paper by digital printing, rotogravure technique, or a rotary screen to yield a printed paper. The printed paper is fed into a flatbed heat press machine, where the roller is heated at a temperature up to about 400° F., to transfer the dye from the printed paper to the pretreated fabric. In this process, the fabric is laid onto the printed paper, creating direct contact between the pretreated fabric and the printed paper. The temperature of the heat press machine is approximately the sublimation temperature of a disperse dye. At this temperature, the dye sublimes and transfer to the pretreated fabric to yield the dyed fabric.

In 110, the dyed fabric may be made into an article of clothing.

In 112, the dry pretreated fabric is used to prepare an article of clothing. Any article of clothing conventionally known in the textile industry, such as, for example, underwear (e.g., garments such as bras, panties, hosiery, or camisoles), pants, trousers, khakis, jeans, shirts, shorts, skirts, blouses, tees, tanks, sweaters, dresses, suits, jackets, swimming suits, saris, protective clothing, socks, coats, scarves, footwear, or hats, may be prepared from the treated fabric. Any other article of manufacture that is known to be made from a textile material can also be prepared from the pretreated fabric. In 114, the article of clothing prepared from the pretreated fabric may be dyed with at least one disperse dye as described herein with respect to dyeing of a pretreated fabric to yield a dyed article of clothing.

Fabric Treatment with Disperse Dye-Containing Compositions

Figure 2:
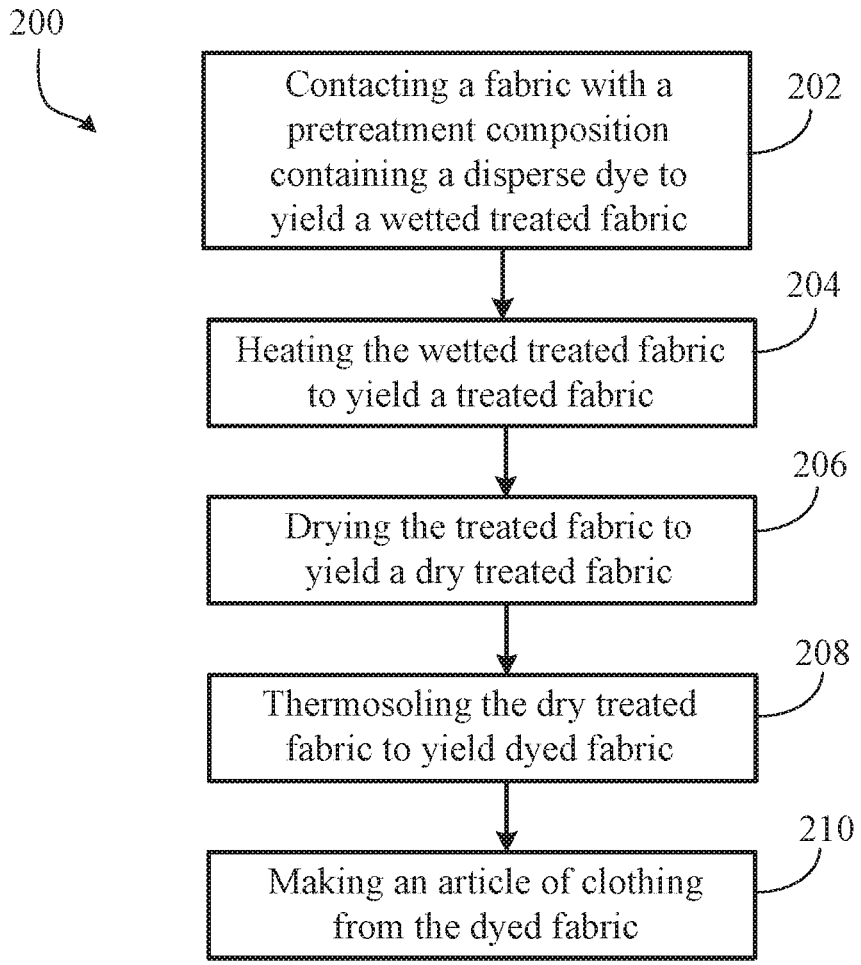
FIG. 2 is a flow chart for an exemplary method of treating a fabric with a liquid treatment composition to obtain a treated fabric, dry treated fabric, dyed fabric, or an article of clothing prepared form the dyed fabric.

FIG. 2 is a flow chart showing operations in exemplary process 200 for treating fabric with a disperse dye-containing composition. In 202, a fabric is contacted with a composition including a pretreatment composition and a disperse dye to yield a wetted treated fabric. In some embodiments, the wetted treated fabric contains particles of disperse dye adsorbed on the surface of the fabric. In some embodiments, the fabric is a garment.

In some embodiments, treating the fabric with a liquid disperse dye-containing composition is carried out using any one of the padding protocols described herein with respect to pretreating the fabric with the pretreatment composition. In some embodiments the treating is carried out at about 100% WPU. In one example, when the fabric is a garment, the dye-containing composition may be applied to the garment using mist and tumble method at about 100% WPU.

In 204, the wetted treated fabric is heated to yield a treated fabric. The treated fabric contains a urethane formed by a reaction of the hydrocarbon wax, the crosslinking agent, and cellulose in the fabric. The disperse dye remains adsorbed on the surface of the treated fabric during heating. Heating of the wetted fabric removes about 60-80 wt. % of water from the wetted fabric.

In 206, the wetted treated fabric is dried at a temperature above the melting point of the hydrocarbon wax to yield the dry treated fabric. The drying may be carried out as described herein with respect to the pretreated fabric.

In some embodiments, the drying of the wetted treated fabric is carried out in several steps. In one example, the wetted fabric is dried using a hot flue air dryer, infrared (IR) radiation, or a combination thereof. This first drying step results in the removal of about 60-80 wt. % of water from the wetted treated fabric. In the following drying step, the padded fabric is dried using heated cylinders or the fabric is thermosoled in the first zones of the tenter frame around 150° C. to yield the dry treated fabric. In one example, when the fabric is a garment, the wetted treated garment is tumble dried at about 150° C. In some embodiments, the disperse dye remains adsorbed on the surface of the fabric throughout drying. In some embodiments, the residual moisture content in the dry treated fabric is at most 2 wt. %, at most 1 wt. %., or at most 0.5 wt. %. In some embodiments, the dry treated fabric contains a urethane compound formed by reaction of a hydrocarbon wax, a crosslinking agent, and cellulose in the fabric. The urethane compound is formed as described herein with respect to the pretreatment of fabric with a pretreatment composition. In some embodiments, the disperse dye remains adsorbed on the surface of the dry treated fabric.

In 208, the dry treated fabric is thermosoled to yield a dyed fabric. As used herein, the term "thermosol" refers to a process of contacting a dry fabric with a disperse dye at a temperature that is higher than the sublimation temperature of the disperse dye.

In some embodiments, the dry treated fabric is thermosoled by contacting the dry treated fabric with a hot metal surface, or by contacting the dry treated fabric with hot air at a temperature in the range of about 190° C. to about 210° C., for a time period from about 30 seconds to about 5 min, or from about 1 min to about 2 min. In some embodiments, the fabric is thermosoled for about 90 seconds. In one example, when the fabric is a garment, the dry treated garment may be garment cured for about 90 seconds at about 210° C. In the garment curing process, the garment is placed in an insulated oven at a temperature above the sublimation temperature of a disperse dye, such that the dye sublimes into the fabric. In some embodiments, during a thermosol process, when the dry treated fabric is heated at or above the sublimation temperature of the disperse dye, the disperse dye sublimes and the hydrocarbon wax absorbs the dye vapor. The dye diffuses into the hydrocarbon wax, thereby coloring the fabric. In some embodiments, the thermosoled dyed fabric is scoured at about 40° C. (without an afterclear) to provide the fabric dyed with the disperse dye.

In 210, the dyed fabric may be made into an article of clothing.

EXAMPLES

Materials and Methods

Chemical Compounds

Turpex ACN (polyethylene wax) and Thermocol MP (anti-migrating agent) were purchased from Huntsman. Fadex ECS (UV absorber) was purchased from Archroma. PW 600 polyester warp sizing agent was purchased from Ulterion. Ruco-Coat FX 8041 (urethane crosslinking agent) was purchased from Rudolf Chemie. Polyethylene wax, anti-migrant, UV absorber, polyester warp sizing agent, and urethane crosslinking agent were obtained as aqueous emulsions. Various disperse dyes were purchased from numerous commercial suppliers.

Fabric

Cotton fabric (greige or bleached) was used in the experiments.

Example 1

Fabric Pretreatment for Conventional and Supercritical $CO_2$ Disperse Dyeing

Preparation of the Fabric Pretreatment Composition:

In the pretreatment bath, water (885 mL) was added. Agitation was started, followed by the slow addition of an aqueous dispersion of Ruco-Coat FX 8041 (15 g), an aqueous emulsion of Turpex ACN (50 g), and an aqueous dispersion of Ulterion PW-600 to the pretreatment bath.

Pretreatment of Fabric for Dyeing with Disperse Dyes:

The pretreatment dispersion was added to the pad liquor trough. The composition was padded onto fabric at 100% wet pick-up. The padded fabric was bone dried in an oven at 150° C.

Example 2

Disperse Dyeing of Pretreated Fabric

The pretreated fabric of Example 1 was loaded into a jet dye machine, a $SCCO_2$ dye machine, or used as a base for sublimation printing. The fabric was dyed with Disperse Blue 79 and Fadex ECS using standard procedures around 130° C. The water dyed fabric was scoured at 40° C., without an afterclear to remove surface dye. The dyed fabric was unloaded from the machine.

Example 3

Fabric Treatment for Thermosol Disperse Dyeing

Preparation of the Fabric Treatment Composition:

In the treatment bath, water was added. Agitation was started, followed by the slow addition of an aqueous dispersion of Ruco-Coat FX 8041 8041 (15 g), an aqueous emulsion of Turpex ACN (50 g), Thermocol (10 g), an aqueous dispersion of Ulterion PW-600, Fadex ECS (25 g), and Disperse Blue 79 to the treatment bath. The amount of water was used such that the total amount of liquid was 1 L.

Thermosol Dyeing of Fabric with Disperse Dyes:

The treatment dispersion was added to the pad liquor trough. The composition was padded onto knitted fabric at 100% wet pick-up. The treated fabric was dried in the thermosol apparatus in the first zones of the tenter frame around 150° C. The dry treated fabric was thermosoled for 90 seconds at 210° C. The water dyed fabric was scoured at 40° C., without an afterclear to remove surface dye. The dyed fabric was unloaded from the machine.

Thermosol Dyeing of Garment with Disperse Dyes:

A garment (e.g., a knitted t-shirt) was treated with the treatment composition using the mist and tumble procedure at 100% wet pick up. The treated garment was tumble dried and then thermosol cured for 90 seconds at 210° C. The dyed garment was scoured at 40° C., without an afterclear. The dyed fabric was unloaded from the machine.

Example 4

Properties of the Dyed Fabric

The efficiency of the compositions and methods of Examples 1-3 for dyeing the cotton fabric with disperse dyes was evaluated using AATCC Test Method 60-2A Washfastness.

Other Embodiments

It is to be understood that while the present application has been described in conjunction with the detailed description thereof, the foregoing description is intended to illustrate and not limit the scope of the present application, which is defined by the scope of the claims. Other aspects, advantages, and modifications are within the scope of the following claims.

What is claimed is:

1. A liquid fabric treatment composition comprising:
a hydrocarbon wax;
a crosslinking agent; and
a polyester warp sizing agent, wherein the polyester warp sizing agent is anionic and comprises sulfate moieties.

2. The composition of claim 1, wherein the composition is an aqueous dispersion.

3. The composition of claim 1, wherein the hydrocarbon wax comprises polyethylene wax.

4. The composition of claim 3, wherein the polyethylene wax is anionic.

5. The composition of claim 4, wherein the polyethylene wax comprises carboxyl groups.

6. The composition of claim 1, wherein the crosslinking agent comprises a nonionic blocked isocyanate.

7. The composition of claim 1, wherein the crosslinking agent reacts with the hydrocarbon wax and a cellulose-containing fabric to form a urethane.

8. The composition of claim 1, wherein the polyester warp sizing agent comprises sulfated isophthalic acid monomer units.

9. The composition of claim 1, wherein the polyester warp sizing agent comprises sulfated terephthalic acid monomer units.

10. The composition of claim 1, further comprising an ultraviolet light inhibitor.

11. The composition of claim 1, further comprising an anti-migrant.

12. The composition of claim 11, wherein the anti-migrant comprises an acrylamide.

13. The composition of claim 1, further comprising a disperse dye.

14. A method of forming a liquid fabric treatment composition, the method comprising:
combining:
an aqueous solvent,
a hydrocarbon wax,
a crosslinking agent, and
a polyester warp sizing agent,
to form the liquid fabric treatment composition, wherein the polyester warp sizing agent is anionic and comprises sulfate moieties.

15. The method of claim 14, further comprising combining a disperse dye with the liquid fabric treatment composition.

16. A method of treating fabric, the method comprising:
contacting fabric comprising cellulose with a liquid dispersion to yield a pretreated fabric, wherein the liquid dispersion comprises:
a hydrocarbon wax;
a crosslinking agent; and
a polyester warp sizing agent; and
heating the pretreated fabric to yield a treated fabric, wherein the treated fabric comprises a urethane formed by a reaction of the hydrocarbon wax, the crosslinking agent, and the cellulose.

17. The method of claim 16, further comprising dyeing the treated fabric with a disperse dye.

18. The method of claim 16, wherein the liquid dispersion comprises a disperse dye.

19. A liquid fabric treatment composition comprising:
a hydrocarbon wax;
a crosslinking agent;
an ultraviolet light inhibitor; and
a polyester warp sizing agent.

20. A liquid fabric treatment composition comprising:
a hydrocarbon wax;
a crosslinking agent comprising a nonionic blocked isocyanate; and
a polyester warp sizing agent, wherein the liquid fabric treatment composition is an aqueous dispersion.

21. A liquid fabric treatment composition comprising:
a hydrocarbon wax;
a crosslinking agent comprising a nonionic blocked isocyanate; and
a polyester warp sizing agent,
wherein the crosslinking agent reacts with the hydrocarbon wax and a cellulose-containing fabric to form a urethane.

22. A liquid fabric treatment composition comprising:
a hydrocarbon wax;
a crosslinking agent comprising a nonionic blocked isocyanate;
an anti-migrant; and
a polyester warp sizing agent.

* * * * *